US011421413B2

(12) United States Patent
Smith et al.

(10) Patent No.: US 11,421,413 B2
(45) **Date of Patent: *Aug. 23, 2022**

(54) PLUMBING FIXTURE WITH DRAIN-CASTED JET ORIFICE

(71) Applicant: Kohler Co., Kohler, WI (US)

(72) Inventors: Andrew L. Smith, Sheboygan, WI (US); Lawrence E. Duwell, Belgium, WI (US); Donald G. Bogenschuetz, Sheboygan, WI (US); Billy Jack Ahola, Manitowoc, WI (US); Peter W. Swart, Oostburg, WI (US); Scott R. Krebs, Sheboygan Falls, WI (US)

(73) Assignee: Kohler Co.

( * ) Notice: Subject to any disclaimer, the term of this patent is extended or adjusted under 35 U.S.C. 154(b) by 0 days.

This patent is subject to a terminal disclaimer.

(21) Appl. No.: 17/318,553

(22) Filed: May 12, 2021

(65) Prior Publication Data

US 2021/0262215 A1 Aug. 26, 2021

Related U.S. Application Data

(63) Continuation of application No. 16/389,182, filed on Apr. 19, 2019, now Pat. No. 11,028,567.

(51) Int. Cl.
*E03D 11/13* (2006.01)
*E03D 13/00* (2006.01)

(52) U.S. Cl.
CPC ..... *E03D 11/13* (2013.01); *E03D 13/00* (2013.01)

(58) Field of Classification Search
CPC ..... E03D 11/13
USPC ..... 4/301, 311–312, 307
See application file for complete search history.

(56) References Cited

U.S. PATENT DOCUMENTS

| | | | | |
|---|---|---|---|---|
| 493,278 | A | 3/1893 | Madden | |
| 503,491 | A | 8/1893 | O'Brien | |
| 524,150 | A | 8/1894 | Tucker | |
| 555,455 | A | 2/1896 | Lewis | |
| 602,080 | A | 4/1898 | Hutchinson | |
| 628,205 | A | 7/1899 | Lloyd | |
| 650,897 | A | 6/1900 | Hinsdale | |
| 929,786 | A | 8/1909 | Plantier | |
| 1,162,500 | A | 11/1915 | Madden | |
| 1,207,289 | A | 12/1916 | Grant | |
| 1,578,847 | A | 3/1926 | Pennington | |
| 2,066,881 | A | 1/1937 | Groeniger | |
| 2,066,882 | A | 1/1937 | Groeniger | |
| 2,129,398 | A | 9/1938 | Beam | |
| 2,212,538 | A | 8/1940 | Groeniger | |
| 2,566,770 | A | 9/1951 | Marie | |
| 2,703,409 | A | 3/1955 | Manning et al. | |
| 3,218,376 | A * | 11/1965 | Schindler, Jr. | B28B 1/261 264/86 |
| 3,278,151 | A * | 10/1966 | Schindler, Jr. | B28B 1/261 249/58 |

(Continued)

*Primary Examiner* — Lori L Baker
(74) *Attorney, Agent, or Firm* — Lempia Summerfield Katz LLC

(57) ABSTRACT

A plumbing fixture includes a sump and a trapway extending from sump at an inlet of the trapway. A jet orifice is disposed in the trapway at approximately the inlet and defines an angled axis that is oriented upwardly toward an upper wall of the trapway and rearwardly toward an interior of the trapway. The jet orifice is configured to direct fluid from a fluid supply source to the trapway.

20 Claims, 8 Drawing Sheets

(56) References Cited

U.S. PATENT DOCUMENTS 3,405,203 A * 10/1968 Derror ..... E03D 11/02 264/69
3,461,194 A * 8/1969 Alexander ..... B28B 1/26 264/86
3,591,869 A 7/1971 Manning
3,812,229 A * 5/1974 Anderson ..... B28B 1/005 264/602
3,836,312 A * 9/1974 Derror ..... B28B 13/06 425/441
3,852,017 A * 12/1974 Derror ..... B28B 1/267 425/451
4,321,714 A 3/1982 Takai et al.
6,862,752 B2 3/2005 Ohba
6,862,754 B1 * 3/2005 DeMarco ..... E03D 13/00 4/302
7,111,333 B1 9/2006 Lo et al.
7,263,758 B2 * 9/2007 Davies ..... B28B 1/002 264/250
7,636,957 B2 * 12/2009 Funari ..... E03C 1/281 4/144.1
8,006,324 B2 * 8/2011 Ophardt ..... E03D 9/00 4/301
9,243,394 B2 * 1/2016 Brown ..... E03D 13/00
9,353,512 B2 * 5/2016 McHale ..... E03D 11/08
9,879,409 B2 1/2018 Conrad
9,988,803 B2 * 6/2018 Tani ..... E03D 13/00
10,927,537 B2 * 2/2021 Mukerji ..... E03D 5/10
11,028,567 B2 * 6/2021 Smith ..... E03D 11/13
2004/0040076 A1 * 3/2004 Han ..... E03D 11/08 4/300
2004/0040080 A1 * 3/2004 Prokopenko ..... E03D 11/02 4/420
2005/0115042 A1 * 6/2005 Davies ..... B28B 1/26 29/401.1
2006/0260033 A1 11/2006 Preston
2008/0271234 A1 11/2008 Okada et al.
2014/0352047 A1 12/2014 Goldsmith
2015/0275493 A1 10/2015 Yihua
2017/0247871 A1 * 8/2017 Mukerji ..... E03D 11/18
2018/0215519 A1 * 8/2018 Webb ..... B31B 50/26

* cited by examiner

PLUMBING FIXTURE WITH DRAIN-CASTED JET ORIFICE

CROSS REFERENCE TO PRIOR APPLICATION

This application is a continuation under 35 U.S.C. § 120 and 37 C.F.R. § 1.53(b) of U.S. patent application Ser. No. 16/389,182 filed Apr. 19, 2019, which is hereby incorporated by reference in its entirety.

BACKGROUND

The present disclosure relates generally to plumbing fixtures. More specifically, the present disclosure relates to plumbing fixtures that have a trapway with a drain-casted jet orifice.

SUMMARY

At least one embodiment relates to a plumbing fixture. The plumbing fixture includes a sump and a trapway extending from the sump at an inlet of the trapway. A jet orifice is disposed in the trapway at approximately the inlet and defines an angled axis that is oriented upwardly toward an upper wall of the trapway and rearwardly toward an interior of the trapway. The jet orifice is configured to direct fluid from a fluid supply source to the trapway.

Another embodiment relates to a urinal. The urinal includes a bowl and a trapway extending from the bowl at an inlet of the trapway. A jet orifice is disposed in the trapway at approximately the inlet and defines an angled axis that is oriented upwardly toward an upper wall of the trapway and rearwardly toward an interior of the trapway. The jet orifice is configured to direct fluid from a fluid supply source to the trapway to induce a flush cycle.

Yet another embodiment relates to a urinal. The urinal includes a sump and a trapway extending from the sump at an inlet of the trapway. A jet orifice is disposed in the trapway at approximately the inlet. The urinal further includes a first side channel in fluid communication with the jet orifice. The urinal further includes a second side channel in fluid communication with the jet orifice. The second side channel is located opposite the first side channel. The jet orifice defines an angled axis that is oriented upwardly toward an upper wall of the trapway and rearwardly toward an interior of the trapway.

A method of manufacturing a urinal, the method including filling a mold with a liquid slip wherein the liquid slip sets up in the mold, tilting the mold to a predetermined angle relative to a horizontal for draining a remaining portion of the liquid through a drain channel, removing at least component associated with the mold, closing the drain channel, modifying the urinal in an additional operation, and baking the urinal.

A method of manufacturing a urinal, wherein the additional operation includes a radius feature formed in the urinal. A method of manufacturing a urinal, wherein the additional operation includes a punch hole. A method of manufacturing a urinal further including coupling a cap to the urinal using liquid slip. A method of manufacturing a urinal further including drying the urinal for a period of time before baking the urinal. A method of manufacturing a urinal wherein the liquid slip is clay. A method of manufacturing wherein the component associated with the mold includes a pin or a funnel. A method of manufacturing a urinal further including turning the mold over to provide access to the at least one component associated with the mold. A method of manufacturing a urinal, the urinal including a sump, a trapway extending from the sump at an inlet of the trapway, and a jet orifice disposed in the trapway at approximately the inlet, wherein the jet orifice defines an angled axis that is oriented upwardly toward an upper wall of the trapway and rearwardly toward an interior of the trapway, and wherein the jet orifice is configured to direct fluid from a fluid supply source to the trapway to induce a flush cycle.

This summary is illustrative only and is not intended to be in any way limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Generally speaking, a plumbing fixture, such as a urinal or a toilet, can include an orifice (sometimes referred to as a "jet orifice") for introducing water into a trapway of the plumbing fixture to assist in draining contents from a bowl or basin of the plumbing fixture through the trapway to a drain pipe or sewer line. Some plumbing fixtures are made from a vitreous material by a casting process, where a slip material or tube is utilized to form a hollow trapway within the plumbing fixture when the plumbing fixture is cast. After the plumbing fixture is cast, a jet orifice is typically formed through a solid casted wall of the plumbing fixture by manually using a punch to fluidly couple the bowl to a fluid channel of the plumbing fixture, where the fluid channel can direct fluid from a fluid supply source to the jet orifice to assist with draining. However, due to the significant amount clearance required to form the jet orifice using a punch and the orientation of the jet orifice relative to the trapway to function properly, the locations in which a jet orifice may feasibly be located on the plumbing fixture are limited. In addition, forming the jet orifice with a punch can result in significant material yield, and can result in inconsistent sizes or shapes of the jet orifice, thereby negatively impacting drain performance.

Referring generally to the FIGURES, disclosed herein are plumbing fixtures (e.g., urinals, toilets, etc.) including a jet orifice that is located approximately at an inlet of a trapway and is oriented upwardly toward an upper wall of the trapway and rearwardly toward an interior of the trapway, so as to provide sufficient fluid flow to the trapway for draining. The jet orifice can, advantageously, be formed at this particular location of the fixture and have this orientation by using a drain casting process instead of a manual punching operation, since it would not be feasible to form a jet orifice at this particular location or with this orientation using a punch, given the limited clearance at the inlet of the trapway. In addition, by forming the jet orifice using a drain-casting process instead of a punch, the jet orifice has a more consistent shape and size with limited or no material yield during the manufacturing process.

Figure 7:
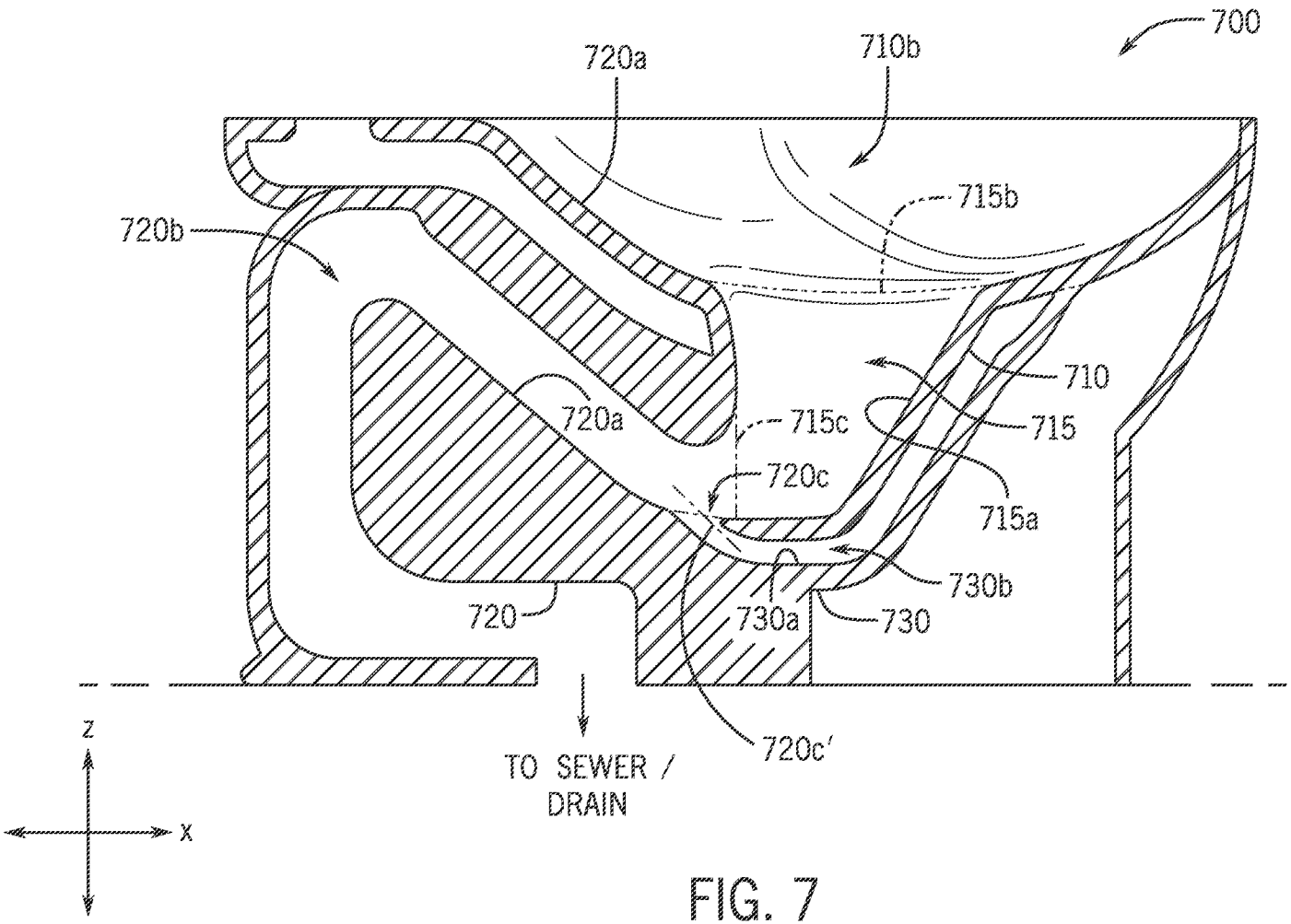
FIG. 7 is a partial cross-sectional view of a toilet including a drain-casted jet orifice according to another exemplary embodiment.
Figure 8:
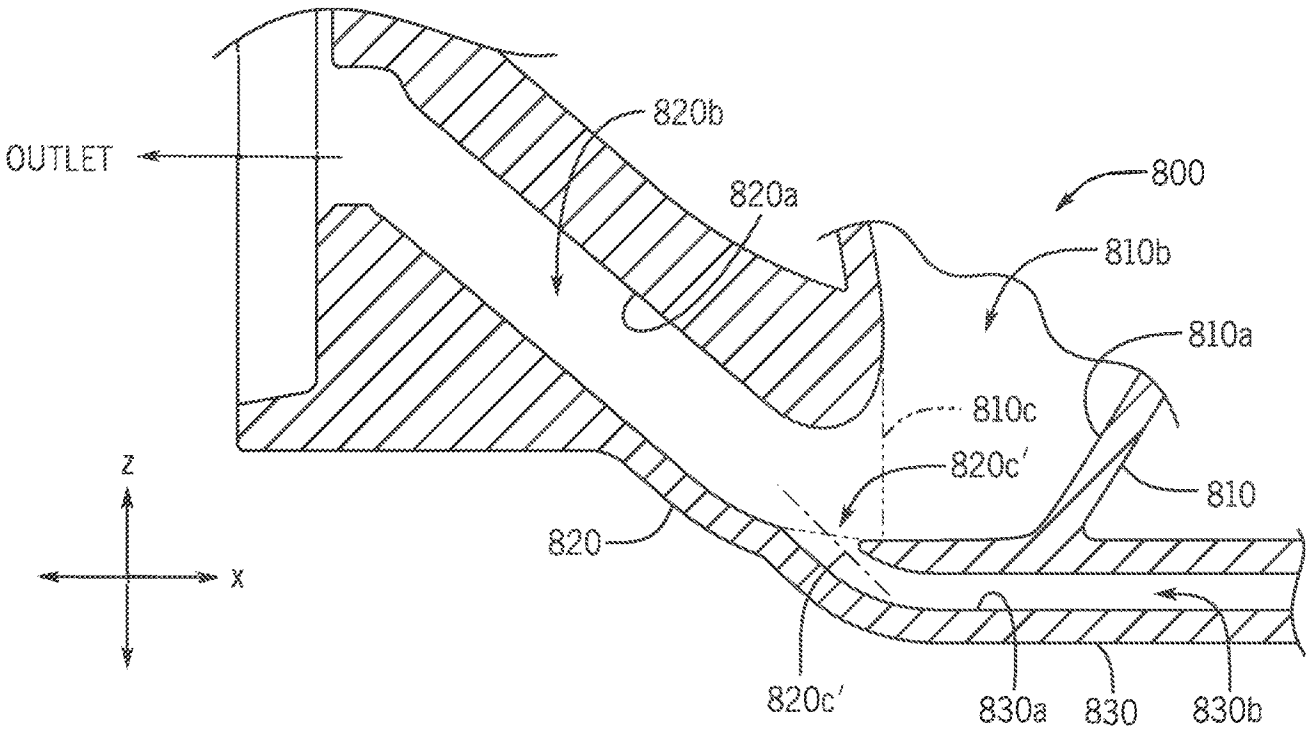
FIG. 8 is a partial cross-sectional view of a trapway system for a plumbing fixture including a drain-casted jet orifice according to another exemplary embodiment.

The following description focuses primarily on a drain-casted jet orifice for a urinal. However, it should be appreciated that the disclosed jet orifice structure and drain casting process can be applied to a variety of other types of plumbing fixtures and trapways, such as toilets, lavatories, or other plumbing fixtures that include a trapway and a drain. For example, FIGS. 7-8 illustrate a toilet and a trapway system, respectively, that each include a drain-casted jet orifice to assist with draining.

Referring to FIGS. 1-4, a urinal 10 is shown according to an exemplary embodiment. In the exemplary embodiment shown, the urinal 10 is made from a vitreous material by a casting process. According to other exemplary embodiments, the urinal 10 is cast from other types of materials or combinations of materials, such as ceramic, composite, epoxy, or other types of materials. The urinal 10 includes unique structural features that can provide for a more robust and consistent structure, as compared to some conventional urinals, and can minimize material waste during the manufacturing process. These and other advantageous features will become apparent to those reviewing the present disclosure.

As shown in FIGS. 1-4, the urinal 10 includes a bowl 12 (e.g., basin, reservoir, etc.) that is defined by a bowl surface 12*a* that forms part of a front portion 16. The urinal 10 further includes a lower portion 14 including an inner trapway surface 14*a* that defines a trapway 14*b* for fluidly coupling the bowl 12 to a sewer or drain pipe at an outlet port 14*d*. The urinal 10 includes a bottom portion 15 including an inner surface 15*a* that defines an opening 15*b* extending outwardly from the lower portion 14 for receiving a removable drain plug (e.g., to assist with winterization of the urinal 10, such as for outdoor applications). An inner portion 18 of the urinal extends upwardly from the bowl 12 and is coextensive with the bowl surface 12*a*. The urinal 10 further includes a first side portion 20 and a second side portion 22 located opposite the first side portion 20. According to the exemplary embodiment shown, the urinal 10 is symmetrical about an x-z plane extending through the middle of the urinal 10, such that the first side portion 20 is the mirror image of the second side portion 22. The urinal 10 further includes an upper portion 26 and a rear portion 24. The urinal 10 is configured to be coupled to, for example, a wall of a building at the rear portion 24 (i.e., the urinal 10 is configured as a wall-hung urinal). It should be appreciated, however, that the urinal 10 may be configured as a floor-mounted urinal, according to other exemplary embodiments.

Referring to FIGS. 3-5A, the urinal 10 includes a sump 13 extending from the bowl 12 at an upper boundary 13*b* to the trapway 14*b* at a lower boundary 13*c*. The lower boundary 13*c* defines an inlet or "mouth" of the trapway 14*b*. The sump 13 is defined by a sump surface 13*a* that extends from the bowl surface 12*a* to the trapway surface 14*a*. The urinal 10 further includes a primary fluid channel 20*b* extending in a substantially longitudinal direction laterally adjacent to the first side portion 20 and the second side portion 22 from an inlet port 26*a* at the upper portion 26. The primary fluid channel 20*b* splits off into a first side channel 21*a* and a second side channel 21*b*. The first side channel 21*a* wraps partially around the bowl 12 along the first side portion 20 toward a front of the urinal 10. Likewise, the second side channel 21*b* wraps partially around the bowl 12 along the second side portion 20 toward a front of the urinal 10. The first side channel 21*a* and the second side channel 21*b* are mirror images of each other, such that the urinal 10 is substantially symmetrical about a plane parallel to an x-z plane extending through the middle of the urinal 10 between the first and second side portions 20,22. In this way, the urinal 10 is less likely to have a manufacturing defect resulting from the casting process (i.e., different structural features of the urinal 10 may have different drying rates, which can cause cracking or morphing of the urinal structure). The first side channel 21*a* and the second side channel 21*b* are each configured to receive a fluid (e.g., water, etc.) from a fluid supply source, such as a household or building water supply, at the inlet port 26 and to direct the fluid to the trapway 14*b* to assist with the flushing process, the details of which are discussed below in the paragraphs that follow. Although not discussed in detail herein, it should be appreciated that the urinal 10 may include a variety of different seals, valves, and actuators to allow for a user to perform a flush cycle, similar to a conventional urinal. As such, the present disclosure should not be limited to the use of any particular seal, valve, or actuator.

Still referring to FIGS. 3-5A, the first side channel 21*a* and the second side channel 21*b* are symmetrical and each extend partially around the bowl 12 from the primary fluid channel 20*b*. The first side channel 21*a* and the second side channel 21*b* each curve below an underside of the bowl 12 around a lateral side of the sump 13 toward the front portion 16. The first side channel 21*a* and the second side channel 21*b* each meet at, and are fluidly coupled to, a drain channel 17*b* that is defined by a drain channel surface 17*a*. The drain channel surface 17*a* extends in front of, and below, the sump 13 between the bottom portion 15 and the sump 13. The drain channel surface 17*a* further extends upwardly in front of the sump 13 and terminates at an upper end 17*b*'. A cap 17 is coupled to a front portion of the urinal 10 adjacent the drain channel 17*b* at the upper end 17*b*' to close off the drain channel 17*b* from an exterior of the urinal 10 during the manufacturing process, the details of which are discussed below with reference to FIGS. 5-6. The drain channel surface 17*a* extends downwardly below a bottom portion of the sump 13 past the lower boundary 13*c* and terminates at a lower portion of the trapway surface 14*a* to define a jet orifice 14*c*. The jet orifice 14*c* fluidly couples the drain channel 17*b* to the trapway 14*b*, such that fluid received at the inlet 26*a* is directed along the primary fluid channel 20*b* to the first side channel 21*a* and the second side channel 21*b* toward the drain channel 17*b* where the fluid is discharged into the trapway 14*b* at the jet orifice 14*c*. In this manner, the jet orifice 14*c* can, advantageously, help to induce a flush cycle by providing a flow of fluid to the trapway 14*b* to direct fluid (e.g., urine, water, etc.) from the bowl 12 and the sump 13 to a sewer or drain pipe at the outlet port 14*d*.

Figure 2:
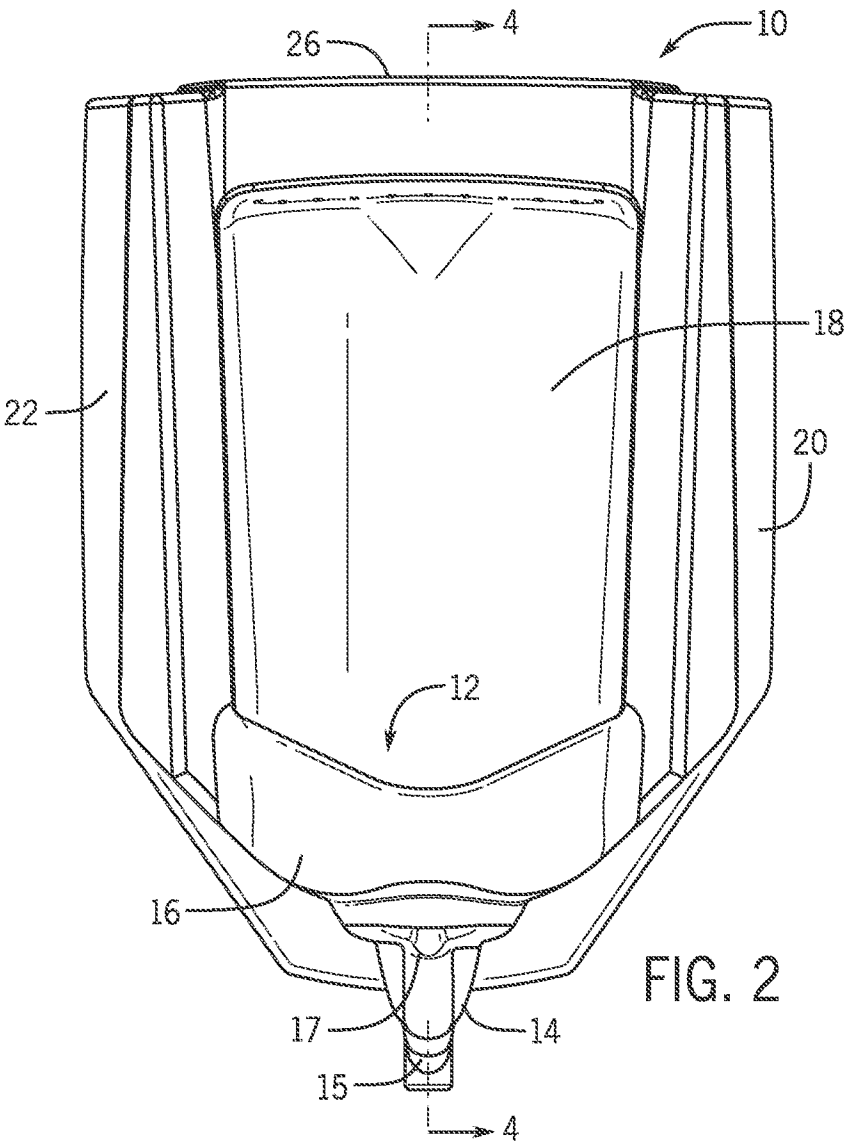
FIG. 2 is a front view of the urinal of FIG. 1.
Figure 1:
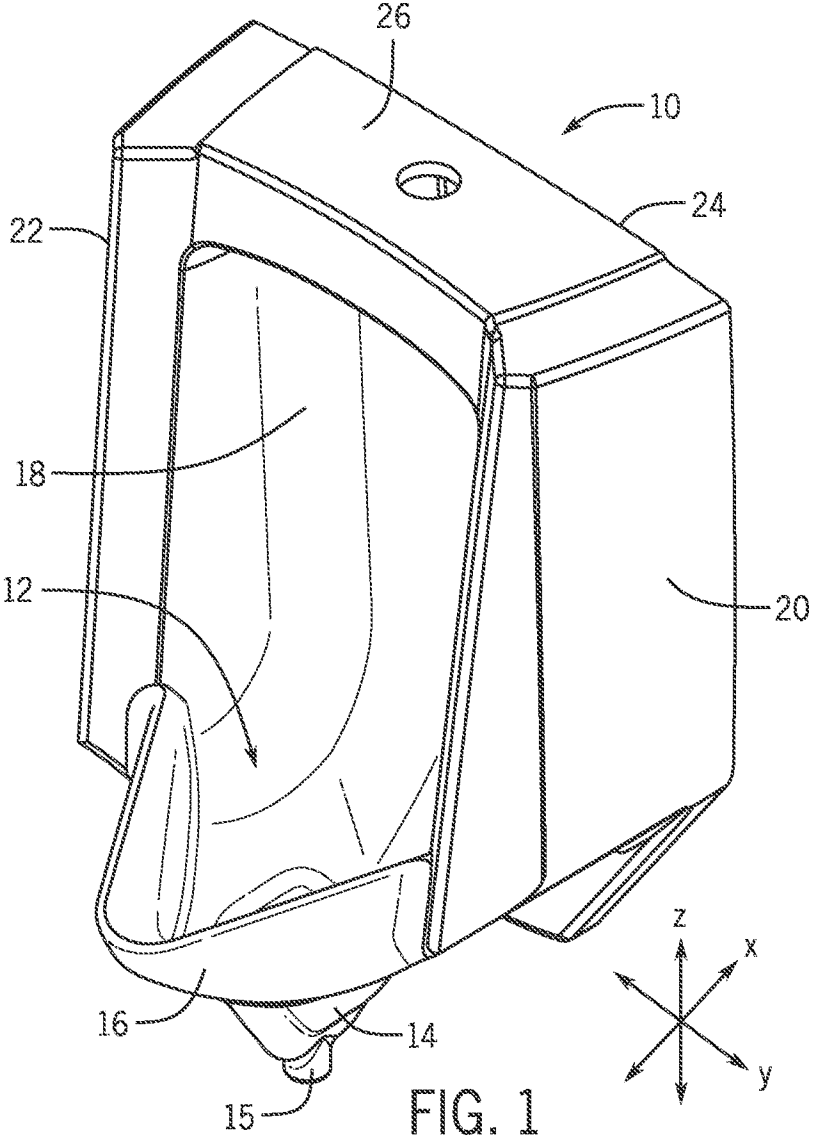
FIG. 1 is a front perspective view of a urinal according to an exemplary embodiment.
Figure 3:
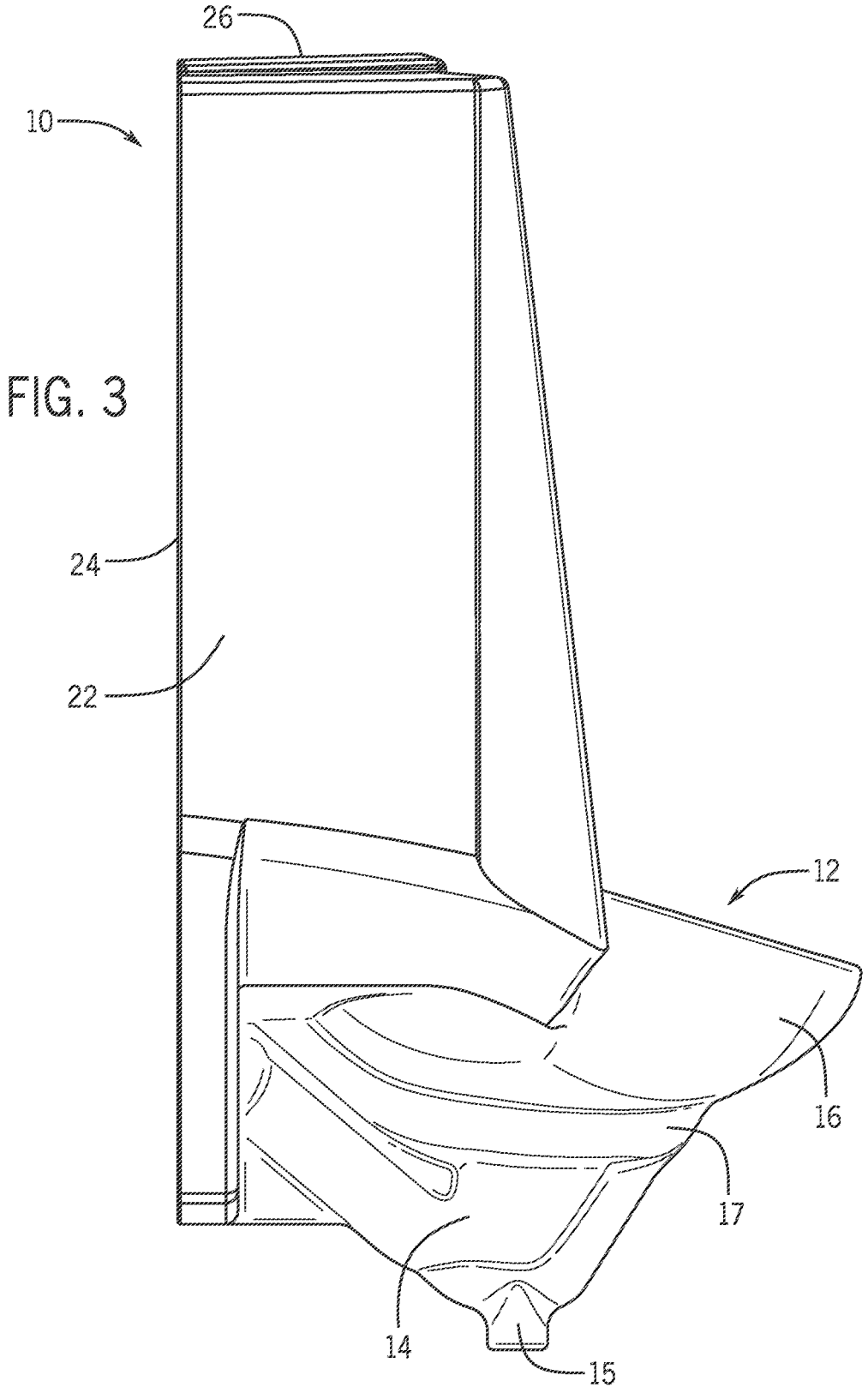
FIG. 3 is a side view of the urinal of FIG. 1.
Figure 4:
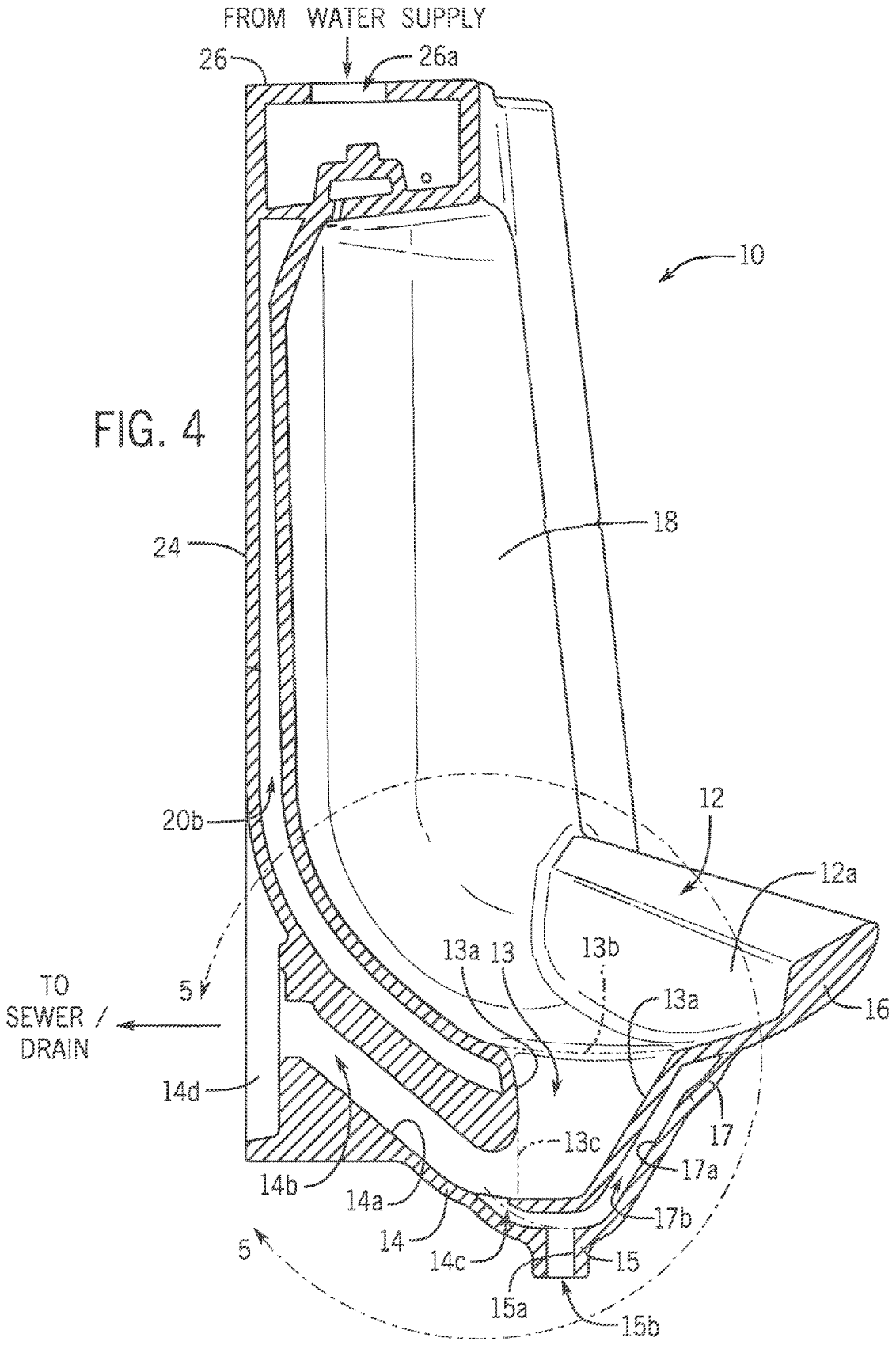
FIG. 4 is a cross-sectional view taken along line 4-4 in FIG. 2.
Figure 5:
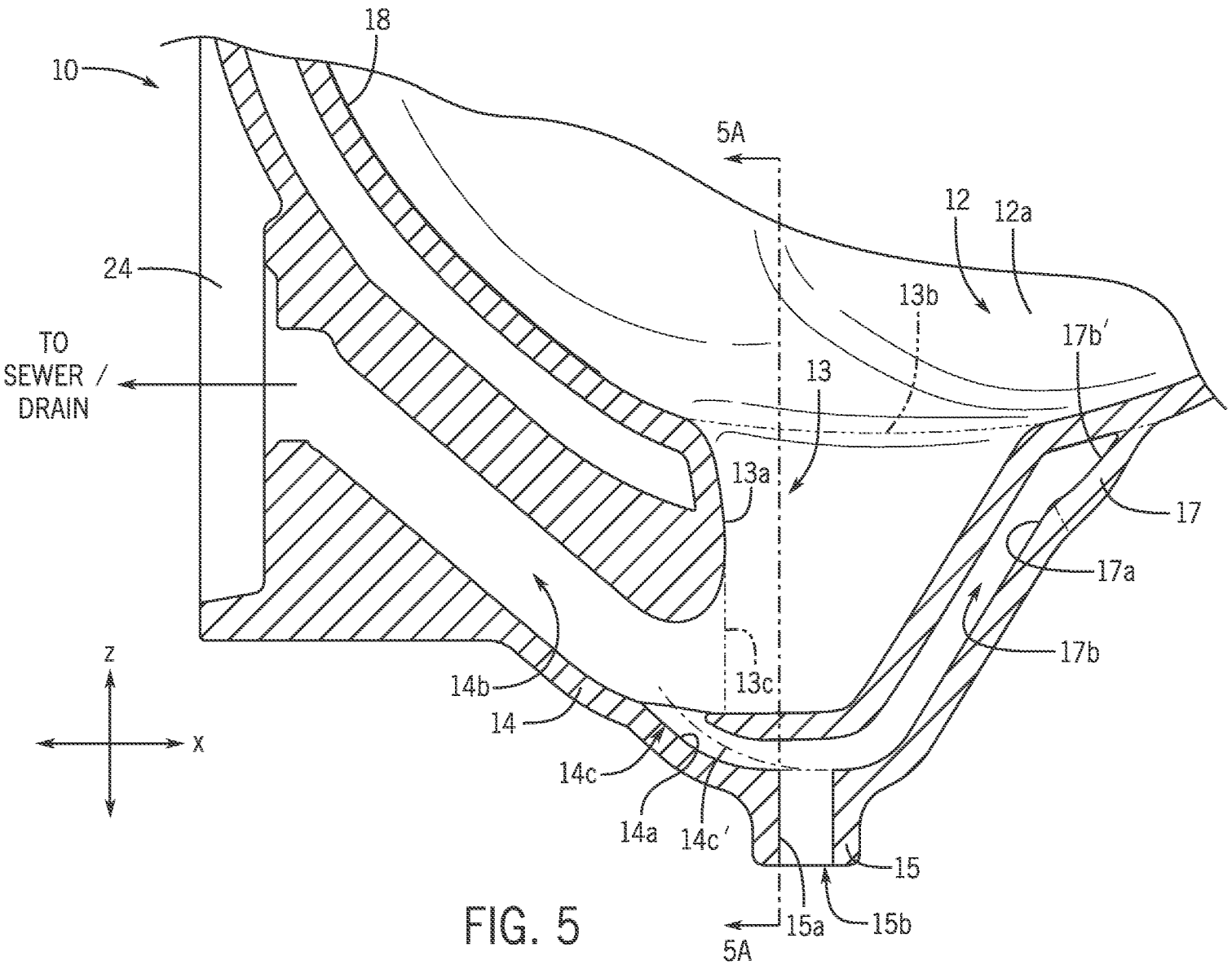
FIG. 5 is a detail view taken of a portion of the cross-sectional view of FIG. 4.
Figure 5A:
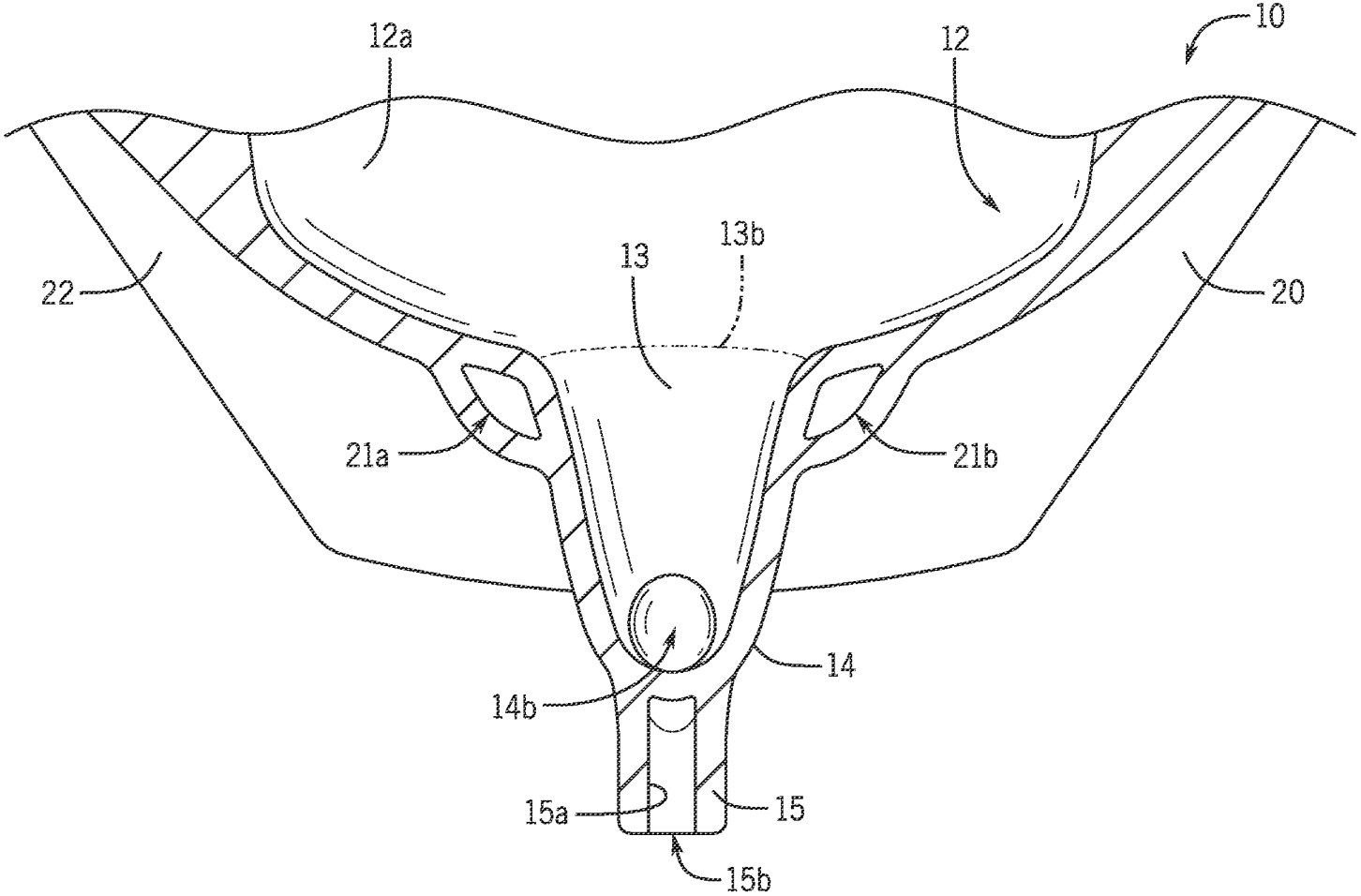
FIG. 5A is a cross-sectional view taken along line 5A-5A in FIG. 5.

Referring to FIGS. 4-5, the jet orifice 14*c* has a particular orientation and relative position that allows for the jet orifice 14*c* to provide for a more consistent and effective flush function, as compared to some conventional urinals. For example, as shown in FIG. 5, the jet orifice 14*c* defines an angled axis 14*c*' that is oriented in an upward direction (i.e., away from the x-axis toward the z-axis) toward an upper portion of the trapway surface 14*a* and rearwardly toward an interior of the trapway 14*b* away from the lower boundary 13*c*. As shown, the jet orifice 14*c* is located rearward of the lower boundary 13*c* at a lower portion of the trapway surface 14*a* approximately at the inlet of the trapway 14*b*. In this way, the amount of noise that may be heard by a user of the urinal 10 as a result of fluid flowing through the jet orifice 14*c* during a flush cycle may be reduced by locating the jet orifice 14*c* inside the trapway 14*b* at approximately the inlet. In addition, the jet orifice 14*c* can provide for an effective evacuation of fluid from the bowl 12 and the sump 13 by locating and orienting the jet orifice 14*c* in the manner shown. According to an exemplary embodiment, the jet orifice 14*c* has a diameter in a range of between about 0.125" (inch) and about 0.50" (inch). This particular range of diameters can, advantageously, provide for an effective flow rate of fluid through the jet orifice 14*c* to the trapway 14*b* to help induce a flush cycle. According to other exemplary embodiments, the jet orifice 14*c* has a different cross-sectional shape, such as square, triangular, trapezoidal, or any other shape, depending on manufacturing preference. According to the exemplary embodiment shown in FIGS. 3-5A, the lower boundary 13*c* has a generally vertical or upright orientation, however, it should be appreciated that the urinal 10 may be formed such that the lower boundary 13*c* is oriented at a different angle (e.g., 45 degrees from vertical, etc.), according to other exemplary embodiments, which may cause the jet orifice 14*c* to be located closer toward the front of the bowl 12, away from the lower boundary 13*c*.

Still referring to FIGS. 4-5, it would not be feasible to use the conventional approach of a manual punching operation to form the jet orifice 14*c* at the location shown in FIGS. 4-5, due to the limited clearance in the trapway 14*b* and the orientation of the jet orifice 14*c*. As such, Applicant designed the urinal 10 such that the jet orifice 14*c* can be formed by a drain-casting process instead of a manual punching operation. By using a drain-casting process to form the jet orifice 14*c*, Applicant was able to form the jet orifice 14*c* at the particular location and orientation shown in FIGS. 4-5, while providing for a consistent shape and size of the jet orifice 14*c* and reducing material waste during the manufacturing process. According to various other exemplary embodiments, the jet orifice 14*c* may be formed at any other desired location within the trapway 14 using a drain-casting process, which is discussed in greater detail below. In addition, the trapway 14 may include a plurality of jet orifices 14*c* each positioned at different locations within the trapway 14, according to other exemplary embodiments.

Figure 6:
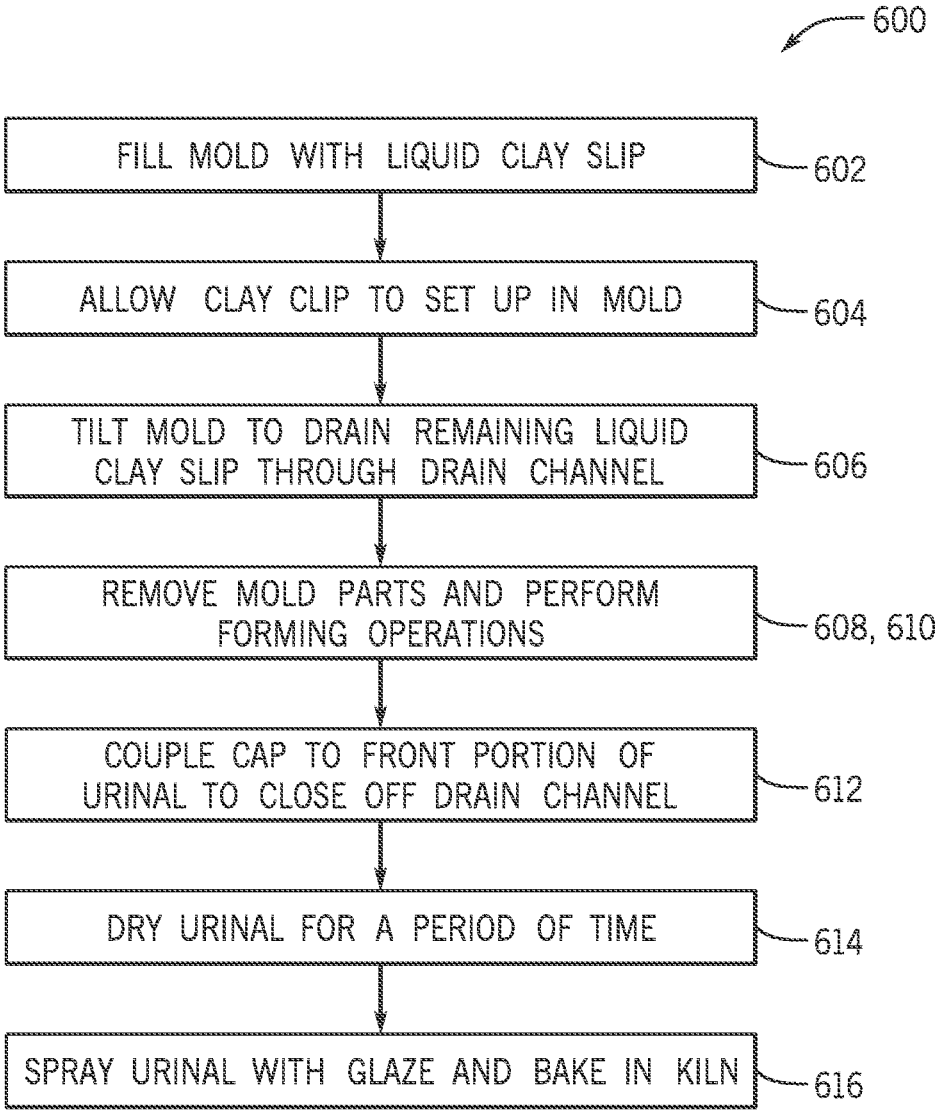
FIG. 6 is a flow chart illustrating a method of forming a drain-casted jet orifice in a plumbing fixture according to an exemplary embodiment.

Referring to FIGS. 5-6, a method 600 of forming the jet orifice 14*c* is shown according to an exemplary embodiment. In a first step 602, a mold having the basic shape and structure of the urinal 10 is filled with liquid clay slip. The mold is oriented such that the rear portion 24 is located on the bottom of the mold with the front portion 16 oriented in an upward direction above the rear portion 24. During the initial forming step 602, the urinal 10 does not include the cap 17 coupled thereto, such that the drain channel 17*b* extends entirely through the upper end 17*b*' to the surrounding environment, so as to define part of a drain-cast pathway of the urinal 10. The liquid clay slip extends through the drain channel 17*b*, the jet orifice 14*c*, and the trapway 14*b* to the outlet port 14*d*. The slip also extends past the drain channel 17*b* and up through the first side channel 21*a*, the second side channel 21*b*, and the primary fluid channel 20*b* to the inlet port 26. In other words, the urinal 10 is designed such that the drain channel 17*b*, the jet orifice 14*c*, the trapway 14*b*, the first side channel 21*a*, the second side channel 21*b*, and the primary fluid channel 20*b* cooperatively define a continuous drain-cast pathway of the urinal 10. In a second step 604, the liquid clay slip may set up in the cast to form the various solid cast walls of the urinal 10. In a third step 606, some components of the mold are removed (e.g., funnels for directing liquid slip into the mold, pins, etc.) and the mold is tilted at an angle relative to horizontal, such that the remaining liquid slip drains from each of the primary fluid channel 20*b*, the first side channel 21*a*, the second side channel 21*b*, the trapway 14*b*, and the jet orifice 14*c* down through the drain channel 17*c* and out of the urinal 10 through the upper end 17*b*'. In this way, the jet orifice 14*c* and the drain channel 17*b*, advantageously, allows for the liquid slip to exit the internal drain-cast pathway of the urinal 10, so as to form the trapway 14*b*, the jet orifice 14*c*, the primary fluid channel 20*b*, the first side channel 21*a*, and the second side channel 21*b* by drain-casting.

Still referring to FIGS. 5-6, in a fourth step 608, the mold may be laid flat with a back piece of the mold removed (i.e., the mold piece adjacent the rear portion 24), such that various forming operations can be performed on the urinal 10 (e.g., holes punched, radii formed, etc.). In a fifth step 610, the mold may be flipped back over to remove the other parts of the mold from the urinal 10 (e.g., a center part, a core, a front part, etc.). In a sixth step 612, the cap 17, which may be made from the same material as the urinal 10, can be coupled (e.g., using slip, etc.) to the urinal 10 at the upper end 17*b*' to close off the drain channel 17*b*. Additionally, the various parting lines and edges of the urinal 10 may be removed or smoothed during step 612. In a seventh step 614, the urinal 10 is dried for a period of time. In an eighth step 616, the urinal 10 can be sprayed with glaze and then baked in a kiln to form the final urinal 10.

Referring to FIG. 7, a toilet 700 is shown according to another exemplary embodiment. According to an exemplary embodiment, the toilet 700 is made from a vitreous material by a casting process. According to other exemplary embodiments, the toilet 700 is cast from other types of materials or combinations of materials, such as ceramic, composite, epoxy, or other types of materials. The toilet 700 includes a bowl 710 having an inlet 710*b* defined by a bowl surface 710*a*. The toilet 700 further includes a sump 715 defined by a sump wall 715*a* that extends from the bowl 710 at an upper boundary 715*b* to a trapway 720 at a lower boundary 715*c*. The lower boundary 720*c* defines an inlet or "mouth" of the trapway 720. In the exemplary embodiment shown in FIG. 7, the lower boundary 720*c* has a generally vertical or upright orientation, however, it should be appreciated that the toilet 700 may be formed such that the lower boundary 720*c* is oriented at a different angle (e.g., 45 degrees from vertical, etc.), according to other exemplary embodiments. The sump surface 715*a* extends from, and is coextensive with, the bowl surface 710 to a trapway surface 720*a* that defines a trapway opening 720*b*. The trapway opening 720*b* extends to an outlet for connecting the toilet 700 to a sewer or drain. In this exemplary embodiment, the toilet 700 including trapway 720 is configured as a siphonic toilet, whereby the contents of the bowl 710 are emptied by creating a siphon effect in the trapway 720, the details of which are discussed below. According to another exemplary embodiment, the toilet 700 may be configured as a "blow-out" style jetted toilet.

The toilet 700 further includes a drain channel 730 extending partially in front of, and below, the sump 715. The drain channel 730 may be fluidly coupled to a fluid supply source, such as a household water supply. The drain channel 730 includes a drain opening 730*b* that is defined by a drain surface 730*a*. The drain surface 730*a* extends upwardly and terminates at the trapway surface 720*a* approximately at the inlet of the trapway 720 to define a jet orifice 720*c* (e.g., sump jet orifice, etc.). The jet orifice 720*c* is located rearward of the lower boundary 715*c* in the trapway 720. The toilet 700 is configured such that the drain channel 730 can direct a flow of water from a fluid supply source to the jet orifice 720*c*, where the flow of water can be introduced into the trapway 720 to, for example, help to prime a siphon in the trapway 720 to induce a flush cycle and empty the contents of the bowl 710.

Similar to the jet orifice 14*c* discussed above, the jet orifice 720*c* has a particular orientation and relative position that allows for the jet orifice to provide for a more consistent and effective flush function, as compared to some conventional toilets. For example, as shown in FIG. 7, the jet orifice 720*c* defines an angled axis 720*c*' that is oriented in an upward direction (i.e., away from the x-axis toward the z-axis) toward an upper portion of the trapway surface 720*a* and rearwardly toward an interior of the trapway 720 away from the lower boundary 715*c*. As shown, the jet orifice 720*c* is located rearward of the lower boundary 715*c* at a lower portion of the trapway surface 720*a* approximately at the inlet of the trapway 720. In this way, the jet orifice 720*c* can provide for an effective evacuation of fluid from the bowl 710 and the sump 715 by locating and orienting the jet orifice 720*c* in the manner shown.

Still referring to FIG. 7, it would not be feasible to use the conventional approach of a manual punching operation to form the jet orifice 720*c* at the location shown in FIG. 7, due to the limited clearance in the trapway 720 and the orientation of the jet orifice 720*c*. As such, similar to the urinal 10 discussed above, Applicant designed the toilet 700 such that the jet orifice 720*c* can be formed by a drain-casting process instead of a manual punching operation. By using a drain-casting process to form the jet orifice 720*c*, Applicant was able to form the jet orifice at the particular location and orientation shown in FIG. 7, while providing for a more consistent shape and size of the jet orifice 720*c* and reducing material waste during the manufacturing process. The jet orifice 720*c* can be formed in a similar manner as the jet orifice 14*c* of the urinal 10 discussed in detail above. According to various other exemplary embodiments, the jet orifice 720*c* may be formed at any other desired location within the trapway 720 using the drain-casting process discussed above. In addition, the toilet 700 may include a plurality of jet orifices 720*c* each positioned at different locations within the trapway 720, according to other exemplary embodiments.

Referring to FIG. 8, a trapway system 800 is shown according to another exemplary embodiment. The trapway system 800 may be coupled to, or integrally formed with, a plumbing fixture, such as a toilet, a urinal, a bidet, a sink, a lavatory, or any other type of plumbing fixture to help facilitate draining. According to an exemplary embodiment, the trapway system 800 is integrally formed from a vitreous material by a casting process. According to other exemplary embodiments, the trapway system 800 is cast from other types of materials or combinations of materials, such as ceramic, composite, epoxy, or other types of materials. The trapway system 800 includes a sump 810 having a sump opening 810*b* defined by a sump wall 810*a* that extends to a trapway 820 at a lower boundary 810*c*. The lower boundary 810*c* defines an inlet or "mouth" of the trapway 820. The sump surface 810*a* extends to a trapway surface 820*a* that defines a trapway opening 820*b*. The trapway opening 820*b* extends to an outlet for connecting the trapway system 800 to a sewer or drain.

The trapway system 800 further includes a drain channel 830 extending partially in front of, and below, the sump 810. The drain channel 830 may be fluidly coupled to a fluid supply source, such as a household water supply, at a water connection point. The drain channel 830 includes a drain opening 830*b* that is defined by a drain surface 830*a*. The drain surface 830*a* extends upwardly and terminates at the trapway surface 820*a* approximately at the inlet of the trapway 820 to define a jet orifice 820*c*. The jet orifice 820*c* is located rearward of the lower boundary 810*c* in the trapway 820. The trapway system 800 may be configured such that the drain channel 830 can direct a flow of water from a fluid supply source to the jet orifice 820*c*, where the flow of water can be introduced into the trapway 820 to, for example, help to drain the contents of a vessel or bowl of a plumbing fixture.

Similar to the jet orifice 14*c* and the jet orifice 720*c* discussed above, the jet orifice 820*c* has a particular orientation and relative position that allows for the jet orifice to provide for a more consistent and effective draining function, as compared to other trapway configurations. For example, as shown in FIG. 8, the jet orifice 820*c* defines an angled axis 820*c*' that is oriented in an upward direction (i.e., away from the x-axis toward the z-axis) toward an upper portion of the trapway surface 820*a* and rearwardly toward an interior of the trapway 820 away from the lower boundary 810*c*. As shown, the jet orifice 820*c* is located rearward of the lower boundary 810*c* at a lower portion of the trapway surface 820*a* approximately at the inlet of the trapway 820. In this way, the jet orifice 820*c* can provide for an effective evacuation of fluid from a plumbing fixture by locating and orienting the jet orifice 820*c* in the manner shown. According to various other exemplary embodiments, the jet orifice 820*c* may be formed at any other desired location within the trapway 820 using the drain-casting process discussed above. In addition, the trapway 820 may include a plurality of jet orifices 820*c* each positioned at different locations within the trapway 820, according to other exemplary embodiments.

Still referring to FIG. 8, it would not be feasible to use the conventional approach of a manual punching operation to form the jet orifice 820*c* at the location shown in FIG. 8, due to the limited clearance in the trapway 820 and the orientation of the jet orifice 820*c*. As such, similar to the urinal 10 and toilet 700 discussed above, Applicant designed the trapway system 800 such that the jet orifice 820*c* can be formed by a drain-casting process instead of a manual punching operation. By using a drain-casting process to form the jet orifice 820*c*, Applicant was able to form the jet orifice at the particular location and orientation shown in FIG. 8, while providing for a more consistent shape and size of the jet orifice 820*c* and reducing material waste during the manufacturing process. The jet orifice 820*c* can be formed in a similar manner as the jet orifice 14*c* of the urinal 10 discussed in detail above.

The disclosed plumbing fixtures include a jet orifice that is located at approximately an inlet of a trapway and is oriented upwardly toward an upper wall of the trapway and rearwardly toward an interior of the trapway, so as to provide sufficient fluid flow to the trapway for draining. The jet orifice can, advantageously, be formed in this particular location of the fixture and have this orientation by using a drain-casting process instead of a manual punching operation. In addition, by forming the jet orifice using a drain-casting process instead of a punch, the jet orifice has a more consistent shape and size with limited or no material yield during the manufacturing process, as compared to jet orifices that are formed using a punch.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that the construction and arrangement of the urinal as shown in the various exemplary embodiments is illustrative only. Additionally, any element disclosed in one embodiment may be incorporated or utilized with any other embodiment disclosed herein.

What is claimed is:

1. A urinal, comprising:

a sump;

a trapway extending from the sump at an inlet of the trapway; and a jet orifice disposed in the trapway at approximately the inlet;

wherein the jet orifice defines an angled axis that is oriented upwardly toward an upper wall of the trapway and rearwardly toward an interior of the trapway; and wherein the jet orifice is configured to direct fluid from a fluid supply source to the trapway to induce a flush cycle.

2. The urinal of claim 1, further comprising:

a drain channel extending from the jet orifice to a front portion of the urinal.

3. The urinal of claim 2, further comprising:

a cap coupled to the front portion to close off the drain channel.

4. The urinal of claim 2, further comprising:

a first side channel and a second side channel each fluidly coupled to the drain channel and the jet orifice, wherein the first side channel and the second side channel are each configured to provide a flow of fluid from the fluid supply source through the drain channel to the jet orifice.

5. The urinal of claim 4, wherein the first side channel and the second side channel are each fluidly coupled to a primary fluid channel, and wherein the primary fluid channel extends in a substantially longitudinal direction between a first side portion of the urinal and a second side portion of the urinal.

6. The urinal of claim 1, wherein the jet orifice has a diameter of between about 0.125 inch to about 0.50 inch.

7. The urinal of claim 1, further comprising a bowl fluidly coupled to the sump.

8. The urinal of claim 1, wherein the urinal is formed from a vitreous material.

9. A urinal, comprising:

a sump;

a trapway extending from the sump at an inlet of the trapway;

a jet orifice disposed in the trapway at approximately the inlet, wherein the jet orifice defines an angled axis that is oriented upwardly toward an upper wall of the trapway and rearwardly toward an interior of the trapway;

a first side channel in fluid communication with the jet orifice; and a second side channel in fluid communication with the jet orifice, wherein the second side channel is located opposite the first side channel.

10. The urinal of claim 9, further comprising a drain channel extending from the jet orifice to a front portion of the urinal, wherein the drain channel is fluidly coupled to the first side channel, the second side channel, and the jet orifice.

11. The urinal of claim 10, further comprising a cap coupled to the front portion to close off the drain channel.

12. A method of manufacturing a urinal, the method comprising:

filling a mold with a liquid slip, wherein the liquid slip sets up in the mold;

tilting the mold to a predetermined angle relative to a horizontal for draining a remaining portion of the liquid through a drain channel;

removing at least one component associated with the mold;

closing the drain channel;

modifying the urinal in an additional operation; and baking the urinal.

13. The method of manufacturing of claim 12, wherein the additional operation includes a radius feature formed in the urinal.

14. The method of manufacturing of claim 12, wherein the additional operation includes a punch hole.

15. The method of manufacturing of claim 12, wherein closing the drain comprises:

coupling a cap to the urinal using liquid slip.

16. The method of manufacturing of claim 12, further comprising:

drying the urinal for a period of time before baking the urinal.

17. The method of manufacturing of claim 12, wherein the liquid slip is clay.

18. The method of manufacturing of claim 12, wherein the component associated with the mold includes a pin or a funnel.

19. The method of manufacturing of claim 12, further comprising:

turning the mold over to provide access to the at least one component associated with the mold.

20. The method of manufacturing of claim 12, wherein the urinal includes a sump, a trapway extending from the sump at an inlet of the trapway, and a jet orifice disposed in the trapway at approximately the inlet, wherein the jet orifice defines an angled axis that is oriented upwardly toward an upper wall of the trapway and rearwardly toward an interior of the trapway; and wherein the jet orifice is configured to direct fluid from a fluid supply source to the trapway to induce a flush cycle.

* * * * *